US007785141B2

(12) United States Patent
Ting

(10) Patent No.: US 7,785,141 B2
(45) **Date of Patent: *Aug. 31, 2010**

(54) STACKED CARD CONNECTOR

(75) Inventor: Chien-Jen Ting, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

This patent is subject to a terminal disclaimer.

(21) Appl. No.: 12/215,731

(22) Filed: Jun. 30, 2008

(65) Prior Publication Data

US 2009/0011650 A1 Jan. 8, 2009

(30) Foreign Application Priority Data

Jul. 2, 2007 (TW) ..... 96123942 A

(51) Int. Cl.
*H01R 13/66* (2006.01)

(52) U.S. Cl. ..... 439/541.5

(58) Field of Classification Search ..... 439/79, 439/541.5, 630

See application file for complete search history.

(56) References Cited

U.S. PATENT DOCUMENTS 5,316,486 A 5/1994 Tanaka
5,688,130 A * 11/1997 Huang ..... 439/541.5
6,305,951 B1 * 10/2001 Shih et al. ..... 439/79
6,736,671 B2 * 5/2004 Lee ..... 439/541.5
7,063,539 B2 6/2006 Ho
7,086,906 B1 8/2006 Ting
7,207,810 B2 * 4/2007 Kuo et al. ..... 439/79
2006/0141857 A1 6/2006 Ting

* cited by examiner

*Primary Examiner*—Briggitte R Hammond
(74) *Attorney, Agent, or Firm*—Andrew C. Cheng; Wei Te Chung; Ming Chieh Chang

(57) ABSTRACT

A stacked card connector (100) includes a first electrical card connector (1), a second electrical card connector (2) positioned under the first electrical card connector, a retaining member (4) provided on the second card connector and a converting mechanism plate (3) received in the retaining member. The first card connector comprises a first insulating housing (12) and a plurality of first terminals (13) received in the first insulating housing. The second card connector (2) includes a second insulating housing (22) received a plurality of second terminals (23). The first terminal comprises a vertical portion (132), the second terminal comprises a tail portion (232) arranged in a line with the vertical portions of the first terminal. The converting plate comprises a plurality of third terminals (32) electrically connecting with the first and the second terminals.

11 Claims, 6 Drawing Sheets

STACKED CARD CONNECTOR

BACKGROUND OF THE INVENTION

1. Field of the Invention

The present invention relates to a card connector to be used in a personal computer or the like for connecting and disconnecting a card to the personal computer. Here, the card generally refers to a memory card such as personal computer (PC) card or the like.

2. Description of Prior Arts

Modern times, the PC card is always used as an external equipment for increase the storage of the electrical consumer products, like Mobile phone, Digital camera, etc. The electrical card connector is used for electrically connecting the PC card and the electrical consumer products. Specially, a card connector is disclosed by the prior art, which comprises a plurality of card connectors stacked with each other to save the space of the electrical products. Meantime, for improving the quality of signals transmitting, some of stacked card connector use an electrical converting plate to electrical connect with a printed circuit board (PCB).

Said stacked card connector comprises different terminals mating with corresponding holes of the converting plate, and the converting plate is soldered to corresponding circuit on the PCB. However, during assembly, the terminals should be inserted into the holes of the converting plate exactly. Considering the size of the card connector and the converting, the process of inserting is very difficult and easily mismating.

Therefore, we need an improved stacked card connector to solve these problems.

SUMMARY OF THE INVENTION

An object, therefore, of the invention is to provide a stacked card connector, which is easily mating with a converting plate.

In the exemplary embodiment of the invention, a stacked card connector includes a first electrical card connector, a second electrical card connector under the first electrical card connector, a retaining member on the second card connector and a converting mechanism plate received in the retaining member. The first card connector comprises a first insulating housing received a plurality of first terminals. The second card connector includes a second insulating housing received a plurality of second terminals. The first terminal comprises a vertical portion, the second terminal comprises a tail portion arranged in a line with the vertical portions of the first terminal. The converting plate comprises a plurality of third terminals electrically connecting with the first and the second terminals.

Other objects, advantages and novel features of the invention will become more apparent from the following detailed description of the present embodiment when taken in conjunction with the accompanying drawings.

DETAILED DESCRIPTION OF THE PREFERRED EMBODIMENT

An embodiment of the present invention will be described with reference to FIG. 1 through FIG. 6.

Figure 1:
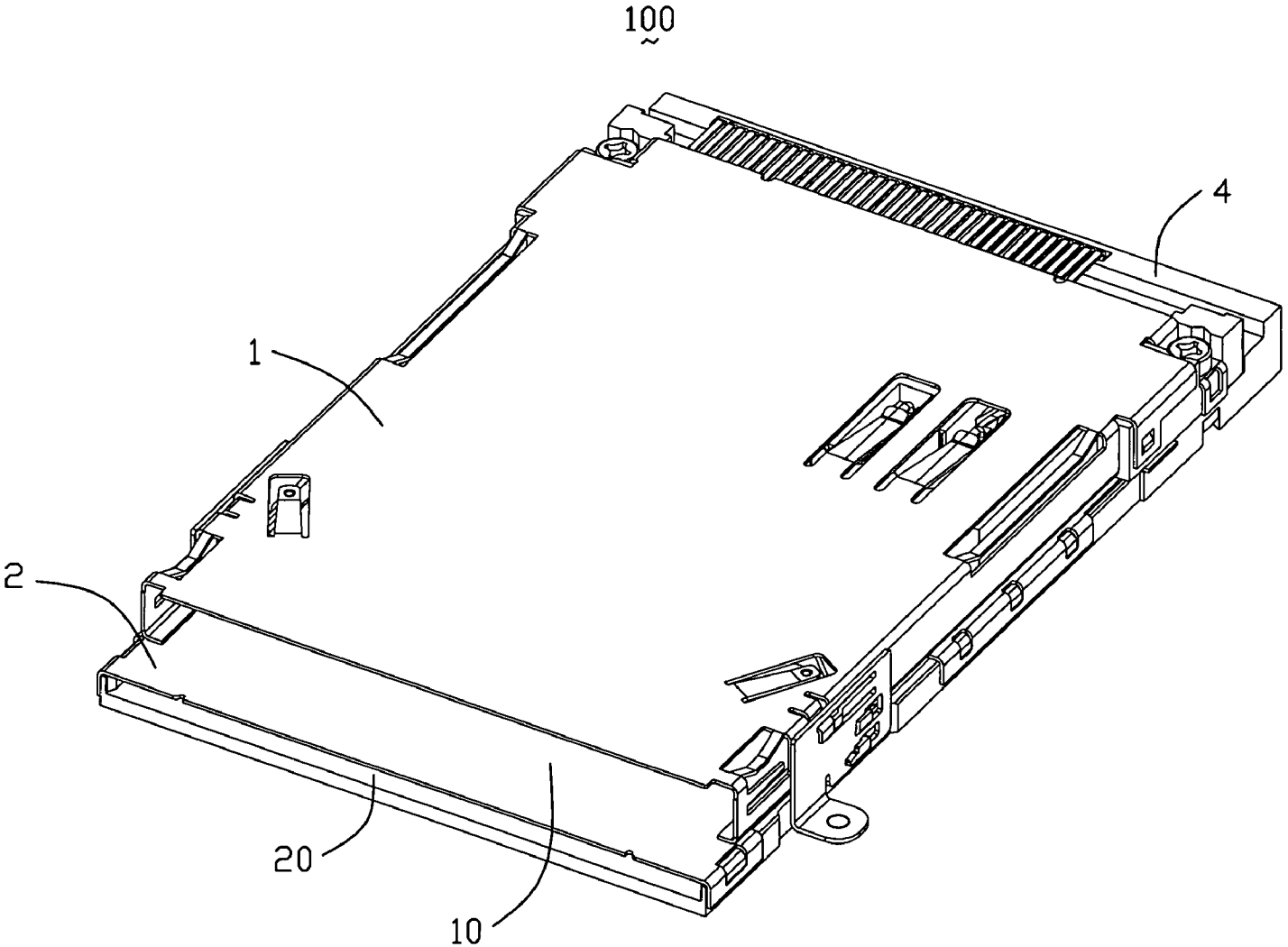
FIG. 1 is a perspective view of a stacked card connector of present invention.

In FIG. 1, a stacked card connector 100 of present invention comprises a first connector 1, a second connector 2 mounted under the first connector 1, a converting plate 3 mating with the first and the second connector 1, 2 and a retaining member 4.

Figure 2:
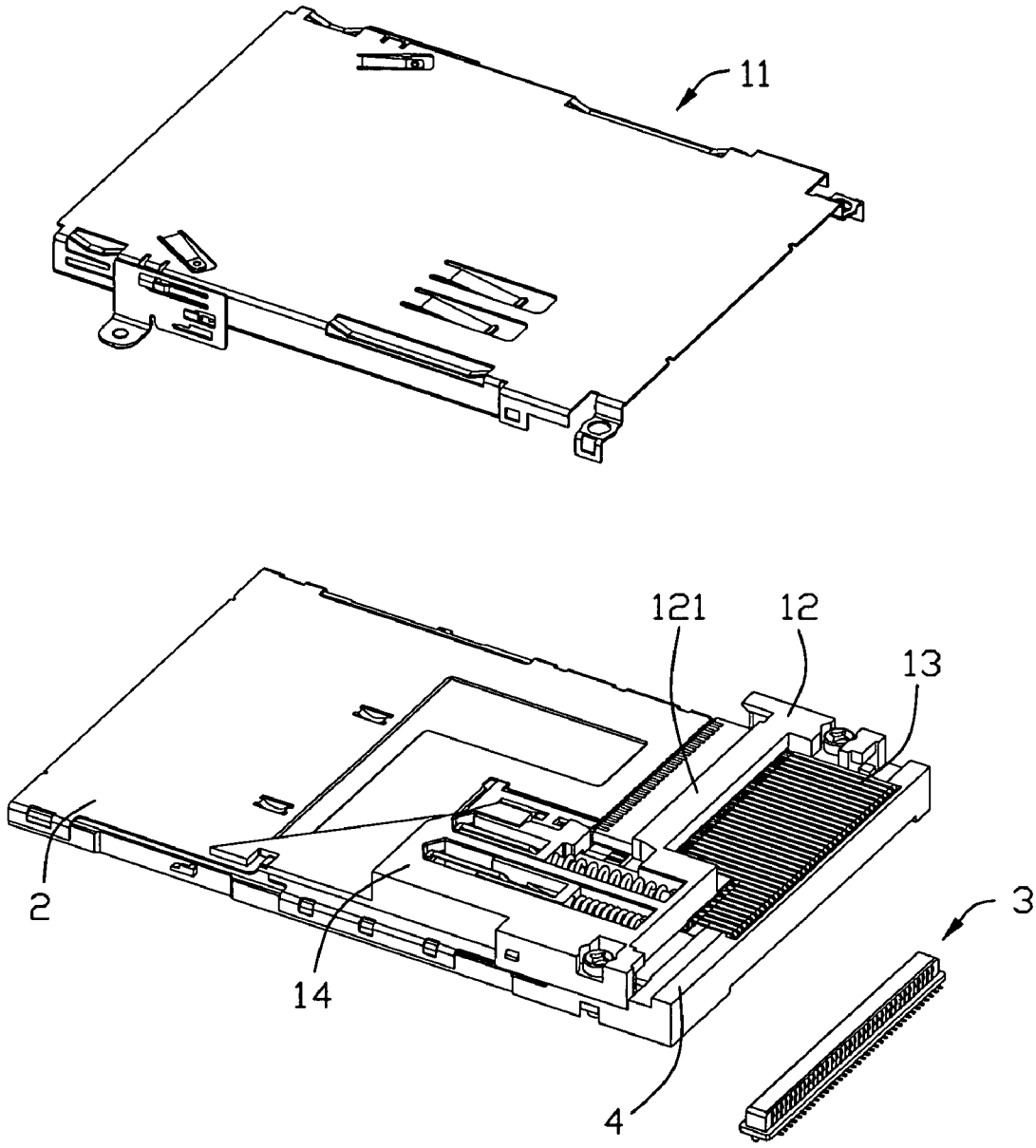
FIG. 2 is a partially exploded view of the stacked card connector of present invention as shown in FIG. 1.

Referring to FIG. 1 to FIG. 2, the first connector 1 is formed in an approximately longitudinal shape, and comprises a first shell 11 in a rectangular shape, and a first insulating housing 12 receiving a plurality of first terminals 13. The first shell 11 defining a first receiving space 10 and a first opening (not labeled) for card inserting, comprises a body plate 111 and a pair of side walls 112 extending downwardly from the body plate 111. The first insulating housing 12 comprises longitudinal base 121 and a base seat 14 extending from an end of the base 121. The first shell 11 connecting with the base 121 of the first insulating housing 12 opposite to the opening. The base seat 14 comprises a triangular guiding block (not labeled). The first terminals 13 partially received in the base 121, comprises a horizontal portion 131 and a vertical portion 132 extending downwardly from an end of the horizontal portion 131. The horizontal portion 131 is retained in the base 121 of the first insulating housing 12.

The second connector 2 comprises a second insulating housing 23, a second shell 21 covering on the second insulating housing 22 and a plurality of second terminals 23 received in the second insulating housing 22. The second shell 21 defines a second receiving space 20 adaptor for receiving a second card. Each second terminal 23 comprises a contacting portion (not labeled), a vertical tail portion 232 beyond the second insulating housing 22 and a horizontally portion 231 connecting the contacting portion and the tail portion 232. The tail portion 232 vertically extends from an end of the connecting portion 231. The vertical portions 132 of the first terminals 13 and the tail portions 232 of the second terminals are arranged in a line in a lateral direction.

Figure 3:
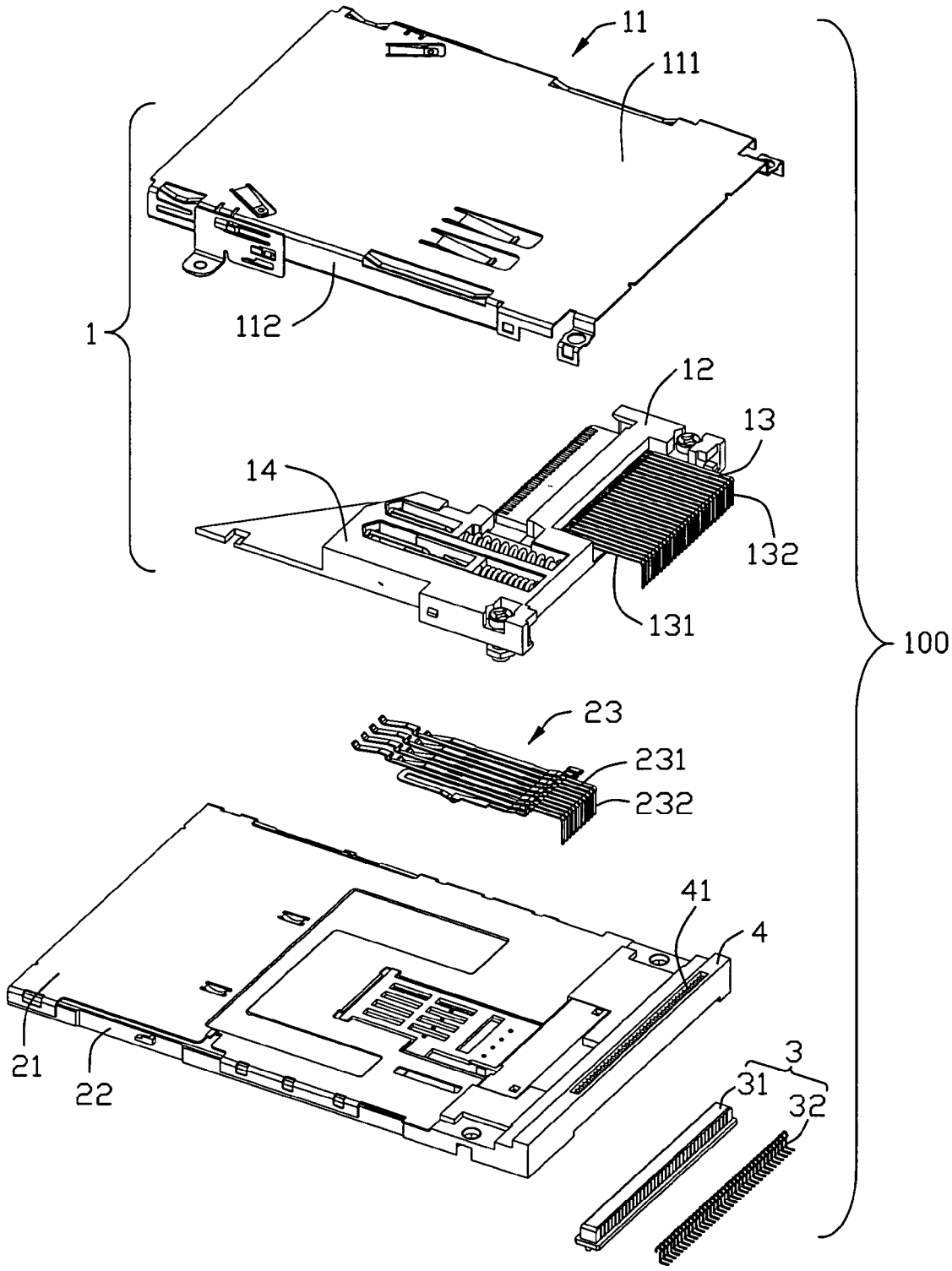
FIG. 3 is an exploded view of the stacked card connector of present invention as shown in FIG. 1.
Figure 4:
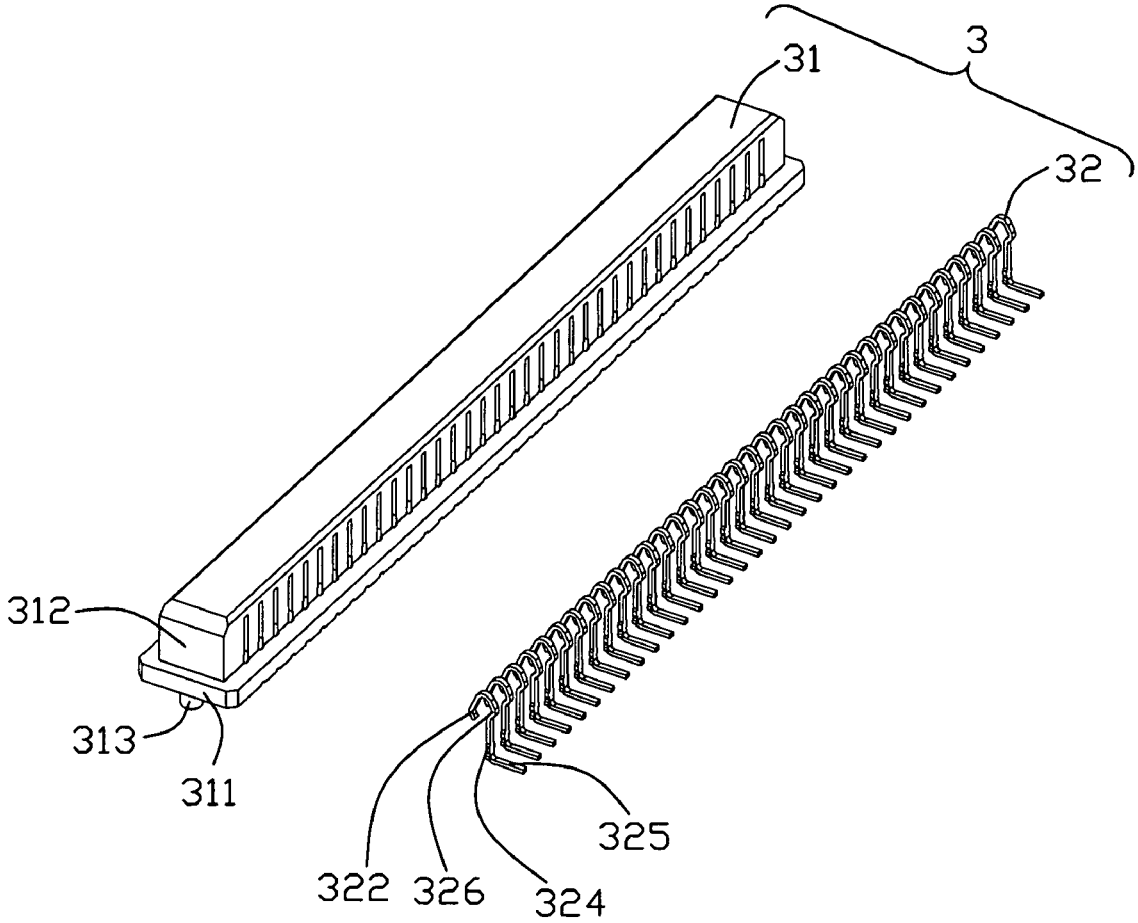
FIG. 4 is an exploded view of a converting plate of the stacked card connector of present invention as shown in FIG. 1.
Figure 5:
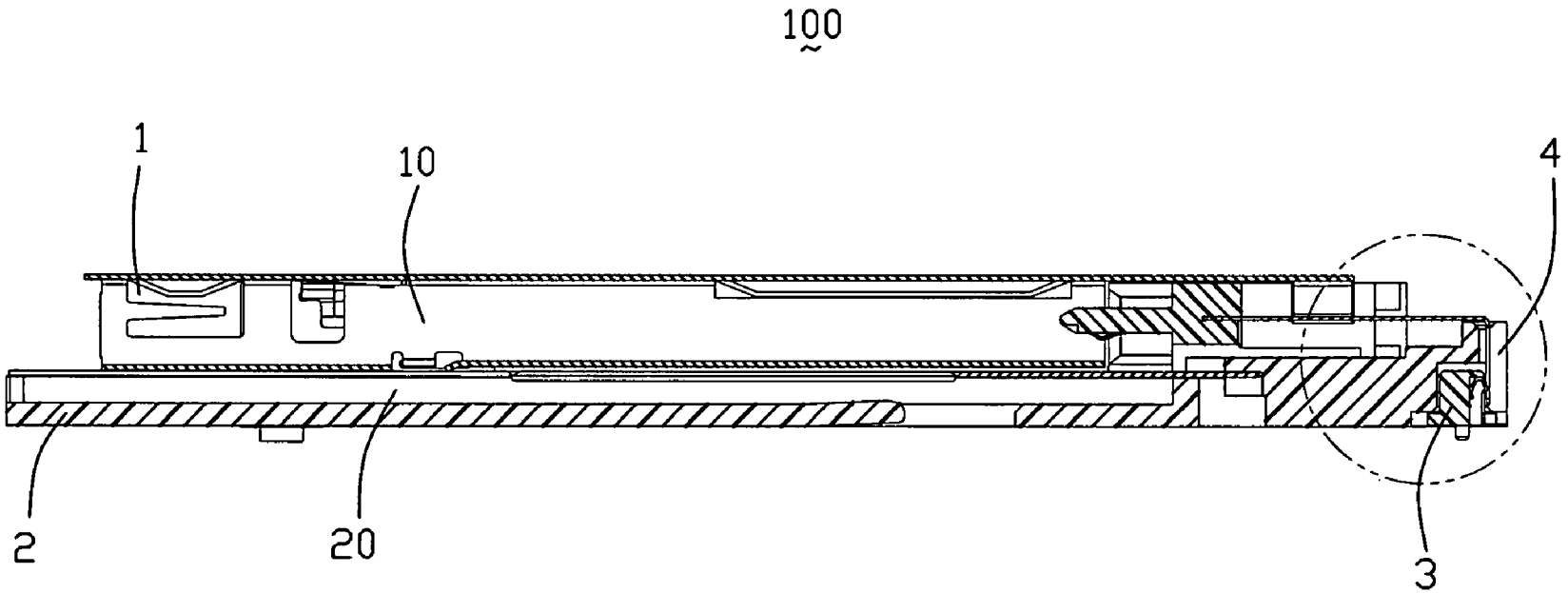
FIG. 5 is a cross-section of the stacked card connector of present invention as shown in FIG. 1.
Figure 6:
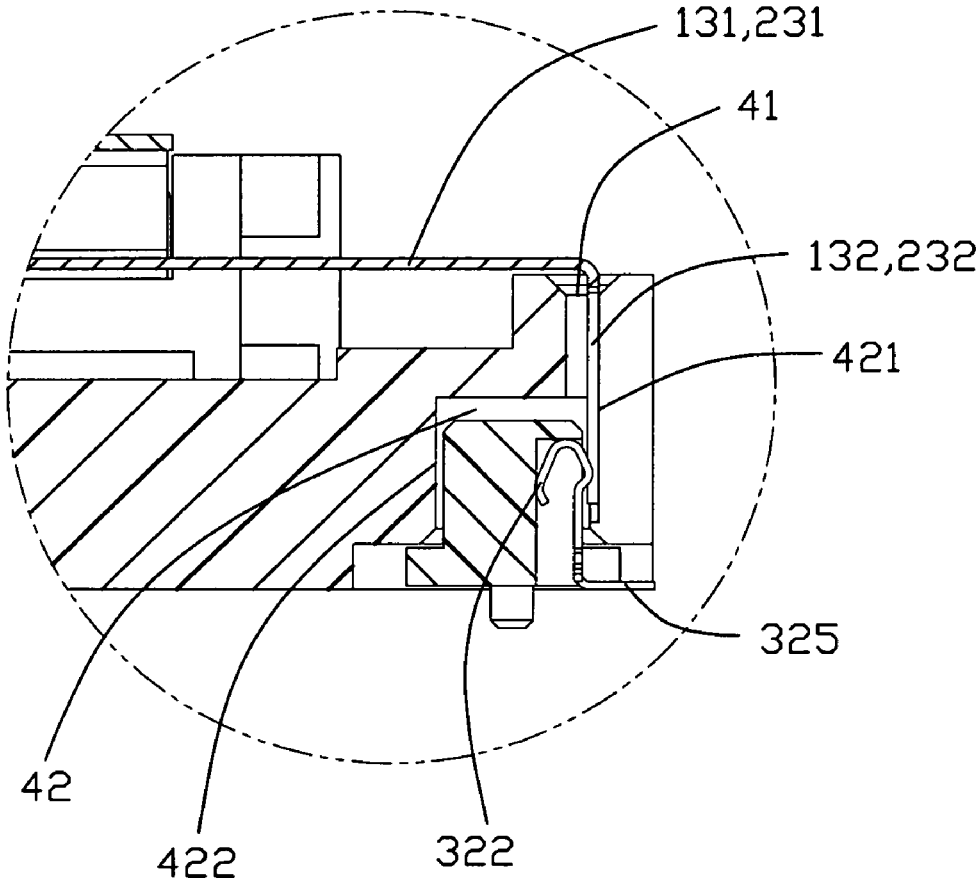
FIG. 6 is an enlarged view of the part labeled in FIG. 5.

As shown in FIG. 2, FIG. 3 and FIG. 6, the second insulating housing 22 forms a retaining member 4 at an end thereof. The retaining member 4 defines a plurality of vertical slots 41 arranged in a line in the lateral direction. The retaining member 4 further comprises a receiving cavity 42 communicating with the vertical slots 41. The vertical slots 41 are provided for corresponding first terminals 13 and the second terminals 23 passing through. The converting plate 3 is received in the receiving cavity 43. The retaining member 4 comprises a front inside surface 421 communicating with the vertical slots 41 and a rear inside surface 422. The vertical portion 132 of the first terminal 13 and the tail portion 232 of the second terminal 23 pass through the vertical slot 41 to attach the front inside surface 421. In this embodiment, the retaining member 4 is integral with the second insulating housing 22. Certainly, the retaining member 4 is capable of separating from the second insulating housing 22.

Referring to FIG. 3-FIG. 6, the longitudinal converting plate 3 comprises a longitudinal body 31, a plurality of third terminals 32. The body 31 comprises a main portion 311, a receiving portion 312 extending upwardly from the main portion 311 and a positioning portion 313 extending downwardly from the main portion 311 to positioning the converting plate 3 on a printed circuit board (PCB). The receiving portion 312 defines a plurality of terminal cavities 314 at a lateral side thereof for receiving the third terminals 32. Each terminal cavity 314 defines a vertical cutout at the lateral surface of the receiving portion 312. Each third terminal 32 comprises a vertically extending retaining part 323, a resilient and curved contacting part 326 bent from the top end of the retaining part 323, a soldering part 325 extending horizontally from the bottom end of the retaining part 323. Each curved contacting part 326 forms free end 322. The third terminals 32 are assembled into corresponding terminal cavities 314 in an up-to-down direction. The retaining parts 323 are retained in the terminal cavities 314, the free ends 322 of the contacting parts 326 are received in the terminal cavities 314 and face to the inside of the terminal cavities 314, the contacting parts 326 are partially beyond the lateral surface of the receiving portion 312 from the cutouts and the soldering parts 325 are beyond the bottom surface of the main portion 311. The converting plate 3 mates with the retaining member 4 with the receiving portion 31 received in the receiving cavities. Correspondingly, the contacting parts 326 of the third terminals 32 electrically connecting with the vertical portion 132 of the first terminals 13 and the tail portions 232 of the second terminals 23 at the front inside surface 421 of the receiving cavity 43.

In this embodiment, the first card is a type of Express card, and the second card is a Smart card.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. A stacked card connector for receiving cards, comprising:

a first electrical card connector comprising a first insulating housing and a plurality of first terminals received in the insulating housing, the first terminal comprising a vertical portion extending vertically;

a second electrical card connector positioned under the first electrical card connector and comprising a second insulating housing received a plurality of second terminals, the second terminal comprising a tail portion extending vertically;

the vertical portions of the first terminals and the tail portions of the second terminals being arranged in a line in a lateral direction perpendicular to a front-to-back direction;

a retaining member provided on the second insulating housing and comprising a receiving cavity, the vertical portions of the first terminals and the tail portions of the second terminals extending into and bearing against an inside surface of the receiving cavity; and a converting plate received in the receiving cavity and defining a lateral surface exposed outside, said converting plate comprising a plurality of third terminals electrically connecting with the vertical portions of the first terminals and the tail portions of the second terminals, each third terminal comprising a contacting part partially extending beyond the lateral surface of the converting plate.

2. The stacked card connector as claimed in claim 1, wherein the first insulating housing comprises a base and a base seat extending from the base.

3. The stacked card connector as claimed in claim 1, wherein the retaining member defines a plurality of vertical slot communicating with the receiving cavity and arranged in a line in the lateral direction.

4. The stacked card connector as claimed in claim 3, wherein said vertical portions of the first terminals and said tail portions of the second terminals pass through corresponding vertical slots.

5. The stacked card connector as claimed in claim 1, wherein the converting plate comprises a body receiving said plurality of third terminals, the body having a main portion and a receiving portion extending from the body, the receiving portion being received in said receiving cavity of the retaining member.

6. The stacked card connector as claimed in claim 5, wherein the third terminal comprises a retaining part retained in the receiving portion and a soldering part extending from one end of the retaining part, said contacting part extending from an opposite end of the retaining part.

7. The stacked card connector as claimed in claim 1, wherein the first card connector comprises a first shell covering on the first insulating housing, the first shell defining a first receiving space.

8. The stacked card connector as claimed in claim 7, wherein the first insulating housing forms a triangular guiding block in the first receiving space.

9. An electrical connector assembly comprising:

an upper connector defining an upper housing equipped with a plurality of upper contacts;

a lower connector stacked with the upper connector and defining a lower housing equipped with a plurality of lower contacts;

tail sections of both said upper contacts and said lower contacts being arranged in only one line in a lateral direction perpendicular to a front-to-back direction;

an auxiliary connector embedded within a rear portion of the lower housing and equipped with a plurality of third contacts in one row simultaneously electrically and mechanically engaged with the tail sections of said upper and lower contacts.

10. The electrical connector assembly as claimed in claim 9, wherein the rear portion of the lower housing defines a plurality of passageways extending through in a vertical direction to allow the tail sections of the upper contacts to pass therethrough.

11. The electrical connector assembly as claimed in claim 10, wherein said passageways further allow the tail sections of the lower contacts to pass therethrough.

* * * * *